US011712731B2

(12) United States Patent
Hoppenkamps et al.

(10) Patent No.: US 11,712,731 B2
(45) Date of Patent: Aug. 1, 2023

(54) ADAPTER, STRETCHER-LEVELLER AND METHOD FOR OPERATING A STRETCHER-LEVELLER

(71) Applicant: SMS group GmbH, Duesseldorf (DE)

(72) Inventors: Nikolaus Hoppenkamps, Moenchengladbach (DE); Gerd Jung, Moenchengladbach (DE); Guenter Panzer, Moenchengladbach (DE); Karsten Busch, Moenchengladbach (DE); Guenter Halleck, Moenchengladbach (DE)

(73) Assignee: SMS group GmbH, Duesseldorf (DE)

( * ) Notice: Subject to any disclaimer, the term of this patent is extended or adjusted under 35 U.S.C. 154(b) by 191 days.

(21) Appl. No.: 16/675,337

(22) Filed: Nov. 6, 2019

(65) Prior Publication Data

US 2020/0070234 A1 Mar. 5, 2020

Related U.S. Application Data

(62) Division of application No. 15/315,403, filed as application No. PCT/DE2015/100203 on May 20, 2015, now Pat. No. 10,507,507.

(30) Foreign Application Priority Data

Jun. 4, 2014 (DE) ..... 10 2014 007 967.8
Jul. 29, 2014 (DE) ..... 10 2014 011 000.1

(51) Int. Cl.
*B21D 25/04* (2006.01)
*B21D 1/00* (2006.01)

(52) U.S. Cl.
CPC ..... *B21D 25/04* (2013.01); *B21D 1/00* (2013.01)

(58) Field of Classification Search
CPC ..... B21D 25/00; B21D 25/02; B21D 25/04; B21D 1/00
(Continued)

(56) References Cited

U.S. PATENT DOCUMENTS 2,352,442 A * 6/1944 Loewy ..... B21D 3/12 72/299
3,986,746 A 10/1976 Chartier
(Continued)

FOREIGN PATENT DOCUMENTS

CN 101249539 A 8/2008
CN 101360572 A 2/2009
(Continued)

OTHER PUBLICATIONS

International Search Report of PCT/DE2015/100203, dated Oct. 22, 2015.
(Continued)

*Primary Examiner* — Shelley M Self
*Assistant Examiner* — Smith Oberto Bapthelus
(74) *Attorney, Agent, or Firm* — Collard & Roe, P.C.

(57) ABSTRACT

In order to widen the field of application of a stretcher-leveler having a minimum nominal width, at least one gripping head of the stretcher-leveler is connected to an adapter having clamping elements for clamping a plate to be stretched, the adapter having a nominal width that is smaller than the minimum nominal width of the stretcher-leveler, and a plate being stretched is connected to the gripping head via the adapter clamping elements and the adapter, before starting the stretching process.

4 Claims, 2 Drawing Sheets

(58) Field of Classification Search
USPC ..... 72/301, 302, 304, 305
See application file for complete search history.

(56) References Cited

U.S. PATENT DOCUMENTS

| | | | | |
|---|---|---|---|---|
| 4,459,838 | A | 7/1984 | Kutz et al. | |
| 4,492,105 | A | 1/1985 | Kutz et al. | |
| 4,726,212 | A * | 2/1988 | Deroche | B21D 3/12 72/302 |
| 7,568,371 | B2 | 8/2009 | Polen et al. | |
| 8,943,869 | B2 | 2/2015 | Li et al. | |

FOREIGN PATENT DOCUMENTS

| | | | |
|---|---|---|---|
| CN | 201603795 | U | 10/2010 |
| DE | 75 39 822 | U | 4/1976 |
| DE | 81 08 328 | U1 | 7/1982 |
| DE | 81 08 327 | U1 | 8/1982 |
| DE | 81 08 357 | U1 | 8/1982 |
| DE | 32 04 560 | A1 | 10/1982 |
| DE | 32 04 648 | A1 | 10/1982 |
| DE | 101 23 657 | A1 | 11/2002 |
| EP | 0 578 362 | A1 | 1/1994 |
| GB | 2 446 921 | A | 8/2008 |
| RU | 2379146 | C2 | 1/2010 |
| WO | 2011/041984 | A1 | 4/2011 |

OTHER PUBLICATIONS

German Office Action in DE 10 2014 011 000.1, dated Jan. 26, 2015, with English translation of relevant parts.

* cited by examiner 20
22
30
32
33
34
36
40
42
44
46
48
49
50
52
54
12
16

ADAPTER, STRETCHER-LEVELLER AND METHOD FOR OPERATING A STRETCHER-LEVELLER

CROSS REFERENCE TO RELATED APPLICATIONS

This application is a divisional of and Applicant claims priority under 35 U.S.C. §§ 120 and 121 of U.S. application Ser. No. 15/315,403 filed on Dec. 1, 2016, which application is a National Stage application under 35 U.S.C. § 371 of PCT Application No. PCT/DE2015/100203 filed on May 20, 2015, which claims priority under 35 U.S.C. § 119 from German Application No. 10 2014 007 967.8 filed on Jun. 4, 2014 and German Application No. 10 2014 011 000.1 filed on Jul. 29, 2014, the disclosures of each of which are hereby incorporated by reference. Certified copies of priority German Application No. 10 2014 007 967.8 and priority German Application No. 10 2014 011 000.1 are contained in parent U.S. application Ser. No. 15/315,403. The International Application under PCT article 21(2) was not published in English.

BACKGROUND OF THE INVENTION

1. Field of the Invention

The invention relates to an adapter for a stretcher-leveler, to a stretcher-leveler, and to an operating method for a stretcher-leveler.

2. Description of the Related Art

Such stretcher-levelers are known from DE 32 04 560 A1 or also from DE 81 08 357 U1, for example, and comprise two gripping heads, in each instance, which can be displaced relative to one another, in a stretching direction, by way of pressure elements, wherein the gripping heads have clamping elements, in each instance, with which a plate can be clamped in place and stretched by means of moving the gripping heads apart.

SUMMARY OF THE INVENTION

It is the task of the present invention to expand the range of use of such a stretcher-leveler.

The task of the invention is accomplished by means of adapters for stretcher-levelers, stretcher-levelers, and operating methods for a stretcher-leveler, having the characteristics of the independent claims. Further embodiments, which can also be advantageous independent of these, are found in the dependent claims as well as in the following description.

Thus an adapter for a stretcher-leveler can comprise an adapter-side connection element to a gripping head of a stretcher-leveler, which head is designed for a minimum nominal stretcher-leveler width, and adapter clamping elements for clamping a plate to be stretched, which elements have a nominal adapter width below the minimum nominal stretcher-leveler width. Such an adapter can then clamp plates, the plate thickness of which—in other words their geometric expanse perpendicular to the expanse of the plate—is smaller than the minimum nominal stretcher-leveler width of the actual gripping head.

Accordingly, a stretcher-leveler having two gripping heads, which can be displaced relative to one another in a stretching direction, have gripping head clamping elements for clamping a plate to be stretched and gripping heads designed for a minimum nominal stretcher-leveler width, can be characterized by a corresponding adapter and a connection element on the gripping head side, which interacts with the connection element on the adapter side.

The forces that occur during stretching of plates, with which forces the plates must be fixed in place on the gripping heads, are significant. Particularly if clamping forces are used, these clamping forces can definitely exceed the forces necessary for stretching. In this respect, stretcher-levelers, i.e. their gripping heads and their related gripping head clamping elements are designed for specific nominal widths, wherein, of course, a maximum plate thickness and a minimum plate thickness can be gripped using such a nominal stretcher-leveler width. In this regard, the term "nominal width" is understood, in the present connection, to mean the nominal gripping width of the maximum and minimum plate thicknesses that can be machined using the corresponding tool, as intended, so that the term "nominal stretcher-leveler width" is correspondingly understood to mean the nominal gripping width of the maximum and minimum plate thicknesses that can be stretched with the corresponding stretcher-leveler, as intended.

In this regard, the maximum nominal stretcher-leveler width is generally restricted by the geometrical dimensions of the respective gripping head, for example in that the gripping head clamping elements can be opened only over a maximum distance relative to one another. Likewise, the minimum nominal stretcher-leveler width is generally restricted in such stretcher-levelers, because in the case of gripping head elements in which the gripping head clamping elements move forward at a slant, the risk of wave formation can then exist in the case of thin plates, because starting from a specific plate thickness, the gripping head clamping elements frequently can too greatly impair the surface of a thin plate that they clamp, and/or because bringing the gripping head clamping elements together very tightly can frequently result in significant construction effort or can be precluded.

By means of the adapter, it is possible, using a stretcher-leveler that has a minimum nominal stretcher-leveler width, i.e. having gripping heads that have the corresponding minimum nominal stretcher-leveler width, to even stretch plates that have a plate thickness that lies below this minimum nominal stretcher-leveler width, since such plates, but possibly also slightly thicker plates, in other words plates that are slightly thicker than the minimum nominal stretcher-leveler width, can be clamped by the adapter, by way of adapter clamping elements, which elements are designed for correspondingly lesser plate thicknesses. Because of the connection elements on the adapter side and the gripping head side, the adapter can then be connected with the respective gripping head, so that then, the stretching forces of the gripping heads can be applied to the plate in the stretching direction, by way of the adapter.

It is understood that such an adapter can also be retrofitted on existing stretcher-levelers, and therefore already makes corresponding advantageous expansion of the range of use of existing stretcher-levelers possible, even separately.

Ultimately, the connection elements as such can be complementary components of any desired two-component connection system that transfers forces sufficiently. The gripping head clamping elements of a gripping head can be used as a connection element on the gripping head side, in particularly simple manner, in terms of design and construction, in that the adapter or specific modules of the adapter are clamped with this gripping head, by way of the gripping head clamping elements of a gripping head. In this manner, no separate modules have to be provided on the respective gripping head, for the connection element on the gripping head side.

Corresponding freedoms in the design of the connection element also occur on the adapter side. It is particularly advantageous if the connection element on the adapter side is structured as a handling plate, which then can be clamped by the gripping head clamping elements, for example. In this regard, it is correspondingly advantageous if this handling plate is structured to have a plate thickness that is greater than or equal to the minimum nominal stretcher-leveler width, so that the respective gripping head or its gripping head clamping element can grip the handling plate in operationally reliable manner. In this embodiment, it is understood that the handling plate is selected not to be thicker than the maximum nominal stretcher-leveler width. In this respect, it is advantageous if the thickness of the handling plate lies within the nominal stretcher-leveler width.

In particular, it is advantageous if the handling plate has two handling plate sides, which are each freely accessible, so that the gripping head clamping elements can easily grip and clamp the handling plate. It is understood that if applicable, gripping surfaces that are not disposed on a plate can be provided, wherein these surfaces have the advantage that the gripping head clamping elements of the stretcher-leveler can interact well with them.

In this regard, it is conceivable, for example, that the handling plate itself is clamped with the adapter or otherwise releasably connected with it. This allows simple replacement of the handling plate on the adapter if wear occurs or if the adapter is supposed to be used on a stretcher-leveler having a different nominal stretcher-leveler width, for example. In this manner, the handling plate can be structured as a wear element, in structurally simple manner.

Completely independent of this, it is advantageous if the connection element on the adapter side has at least one wear element, so that wear occurs on the connection element on the adapter side, in targeted manner, and possible wear on the connection element on the gripping head side is avoided, if at all possible. The latter is particularly advantageous when—as has already been explained above—the gripping head clamping elements are used as a connection element on the gripping head side, because then the useful lifetime of the respective gripping head is impaired as little as possible as the result of using the adapter.

In this respect, it is particularly advantageous if the wear element comprises a wear plate that then comes into contact with one or more corresponding gripping head clamping elements. For example, the entire handling plate can be configured as a wear plate. In particular, however, it is also possible to provide one or more wear plates on the handling plate, which plates can easily be replaced in case of wear, accordingly.

The range of use of a stretcher-leveler is accordingly also increased by means of a method for operating a stretcher-leveler having a minimum nominal stretcher-leveler width, which method is characterized in that at least one gripping head of the stretcher-leveler is connected with an adapter that has adapter clamping elements for clamping a plate to be stretched, having a nominal adapter width below the minimum nominal stretcher-leveler width, and that a plate to be stretched, preferably having a thickness below the nominal stretcher-leveler width—something that is not, however, compulsory—is connected with the respective gripping head by way of the adapter clamping elements and the adapter, before the stretching procedure is initiated.

In this regard, the term "nominal adapter width" is understood to be the nominal gripping width of the maximum and minimum plate thicknesses that can be stretched using the corresponding adapter, as intended.

Preferably, all the gripping heads of the stretcher-leveler are connected with an adapter, in each instance, which has adapter clamping elements for clamping a plate to be stretched, having a nominal adapter width below the minimum nominal stretcher-leveler width, because in general, the plates to be stretched have essentially the same thickness throughout, and the gripping heads of the respective stretcher-leveler generally have corresponding or identical nominal stretcher-leveler width. In this respect, it makes sense not to connect all the gripping heads of the stretcher-leveler with an adapter, in each instance, only when asymmetries occur.

Preferably, first the respective gripping head of the stretcher-leveler is connected with the respective adapter, and subsequently the plate is clamped by way of the adapter clamping elements of the respective adapter and connected with the respective gripping head. This method of procedure leads to lesser stresses on the plates and lowers the risk of wave formation, if applicable, something that is particularly important in the case of thinner plates. It is understood that under particular circumstances, the reverse method of procedure could also be practical.

Operationally reliable clamping, particularly of plates having a great nominal width, is possible if the gripping head clamping elements are adjustable at an acute angle to the plate to be stretched. In this regard, the acute angle will generally open in the stretching direction, so that in the case of a movement in the stretching direction, the stretching forces are directed in such a manner that the gripping head clamping elements are gripped even more strongly. This brings about particularly operationally reliable clamping, but carries the risk, in the case of thinner plates, that the plates are subjected to special stresses, when opening and closing the gripping head clamping elements, which the plates are frequently unable to withstand, and these stresses can lead to wave formation, particularly if the gripping head clamping elements move forward at a slant, for example.

For the latter reason, it is advantageous, on the other hand, if at least one of the adapter clamping elements is adjustable perpendicular to the plate to be stretched, because then, such stresses do not occur. A possibly slightly reduced clamping force caused by the perpendicular adjustability can certainly be accepted in the case of thinner plates and can be compensated, if applicable, by means of greater press-down pressures or forces that are exerted on the adapter clamping elements.

In particular, the combination of adapter clamping elements that are adjustable perpendicular to the plate to be stretched and gripping head clamping elements that are adjustable in an acute angle to a plate to be stretched is accordingly advantageous, because the advantages of perpendicular adjustability can be fully utilized, by way of the adapter, in the case of thinner plates, while the advantages of slanted adjustability by way of the acute angle can be utilized in the case of thicker plates, in the case of which it is possible to do without the adapters, and the disadvantages of the slanted adjustability are actually non-critical in the case of use of the adapter by the connection element, because here, only an effect on the adapter or its modules should occur.

Preferably, at least one of the adapter clamping elements is adjustable relative to an adapter body, thereby making it possible to implement clamping in particularly simple manner. Corresponding adjustability can particularly be implemented hydraulically, because in this manner, correspondingly great clamping forces can also be made available on the adapter, with reasonable construction effort.

If the adapter comprises at least two adapter clamping elements, then these can particularly engage on the plate to be drawn from different sides, and this allows correspondingly advantageous clamping with minimal stress on the plate to be drawn.

Preferably, both adapter clamping elements are adjustable perpendicular to the plate to be stretched, if the adapter comprises at least two adapter clamping elements, thereby making precise positioning of the adapter clamping elements and, in particular, precise orientation of the stretching forces introduced possible. It is understood that even in the case of such an embodiment, it is advantageous if the adapter clamping elements that are adjustable, in each instance, are hydraulically controlled.

Preferably, the adjustable adapter clamping element can be detected with regard to its position or displacement, for example relative to the adapter body, by way of a path measurement system, so that its position and, in particular, also the precise position of the stretching force introduced by way of it can be precisely monitored, controlled or regulated. It is understood that if applicable, measurement systems other than a path measurement system, such as, for example, also a force measurement system or pressure measurement system, can also be provided accordingly, cumulatively or alternatively, in order to be able to precisely control the clamping force or the clamping pressures. If multiple adapter clamping elements are provided on the adapter in displaceable manner, then preferably, at least two or all can be detected in terms of their position, by way of a path measurement system, and/or also with regard to their force stress or pressure stress, by way of other measurement systems.

Hydraulic and/or electrical quick couplings that are complementary to one another can be provided on at least one of the gripping heads and on the adapter, by way of which couplings a hydraulic or electrical supply of the adapter, respectively, is possible in simple manner, for example for hydraulic displacement of the adapter clamping elements or also for transmission of the electrical signals of the path measurement system. In this regard, the direct connection of the respective adapter to the gripping head allows relatively disruption-independent coupling of the adapters to the stretcher-leveler, even independent of the use of quick couplings, because long supply lines can be avoided, in particular, and/or because the hydraulics or electrical equipment of the respective gripping head can also be used for the adapter. Correspondingly fast coupling or connecting of the adapter with the stretcher-leveler can be implemented by way of the quick couplings.

Accordingly, it is advantageous if, before connecting the plate with the respective gripping head by way of the adapter clamping elements, the respective adapter is hydraulically and/or electrically connected with the stretcher-leveler, preferably using the respective gripping head with which it is connected. Here, too, the connection preferably takes place by way of a quick coupling, because this can be implemented in particularly fast and operationally reliable manner.

It is understood that the characteristics of the solutions described above and in the claims can also be combined, if applicable, in order to be able to implement the advantages cumulatively, accordingly.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
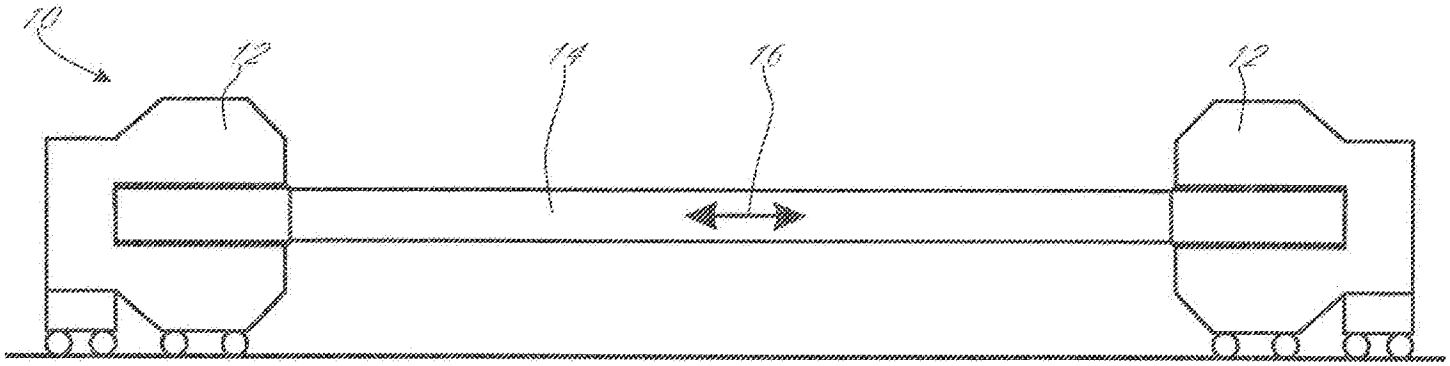
FIG. 1 shows a schematic side view of a stretcher-leveler.
Figure 2:
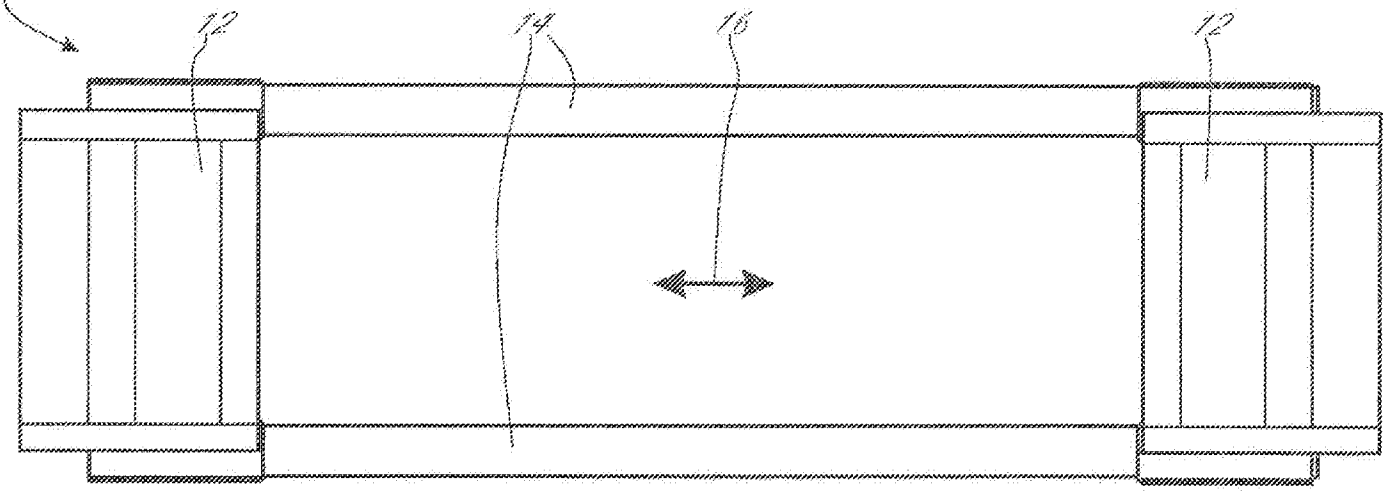
FIG. 2 shows the stretcher-leveler according to FIG. 1 in a top view.

The stretcher-leveler 10 shown in the figures has two gripping heads 12, which can be displaced along a stretching direction 16 by way of two pressure elements 14 configured as rods. In this exemplary embodiment, the two gripping heads 12 can be displaced, wherein it is understood that in different embodiments, only one of the gripping heads is mounted to be displaceable, because ultimately, only a relative movement of the two gripping heads 12 of the stretcher-leveler 10 is important.

Now, plates having a specific nominal stretcher-leveler width can be clamped in place between the two gripping heads 12, by way of gripping head clamping elements 52 (see FIG. 5), and stretched in the stretching direction 16.

Figures 3, 4, 5:
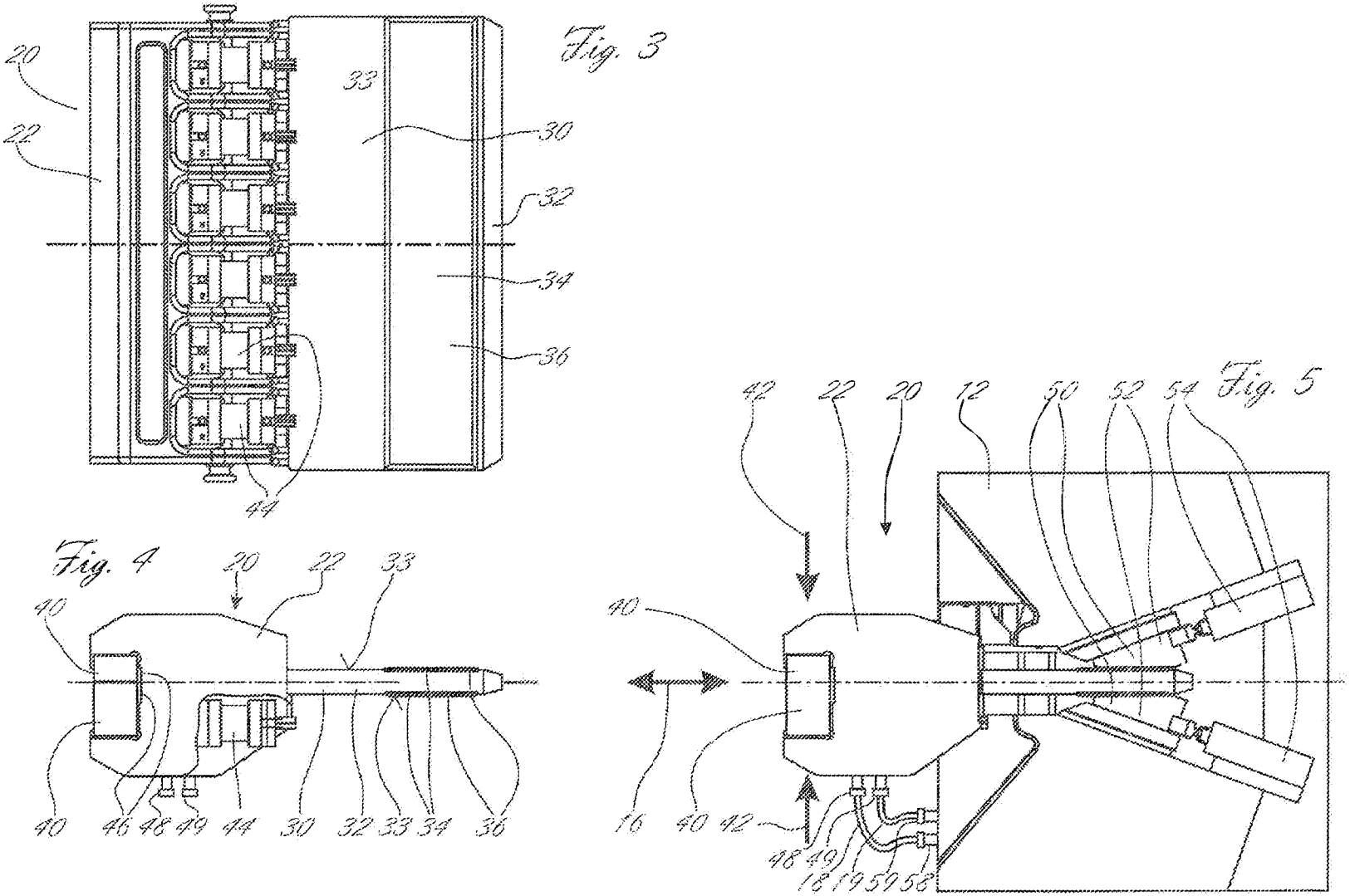
FIG. 3 shows an adapter for the stretcher-leveler according to FIGS. 1 and 2 in a top view.
FIG. 4 shows the adapter according to FIG. 3 in a side view.
FIG. 5 shows the adapter according to FIGS. 3 and 4 set into a gripping head according to FIGS. 1 and 2.

As is evident from FIG. 5, the gripping head clamping elements 52 can be adjusted in an acute angle to the stretching direction 16 or to the plate to be stretched, by way of clamping hydraulics 54 for the gripping head 12; this guarantees good clamping particularly also during stretching.

The stretcher-leveler 10 structured in this manner is designed for a specific nominal stretcher-leveler width, wherein the maximum nominal stretcher-leveler width follows from the maximum opening of the gripping head clamping elements 52, while the minimum nominal stretcher-leveler width is brought about in that the gripping head clamping elements are moved toward one another only up to a minimum distance and can apply sufficient clamping forces even at this minimum distance, and that plates that are thinner than the minimum nominal stretcher-leveler width are subject to the risk of damage caused by the gripping head clamping elements 52.

Accordingly, this arrangement comprises an adapter 20 (see FIGS. 3 to 5), which has an adapter body 22 on which a handling plate 32 is disposed as a connection element 30 on the adapter side. In this exemplary embodiment, the handling plate 32 is fixedly connected with the adapter body 22 and has two handling plate sides 33 that lie opposite one another, which sides are freely accessible in the respect that the gripping head clamping elements 52 can grip and clamp the handling plate 32. It is understood that in different embodiments, a one-piece design or also a different placement of the handling plate can be provided, if applicable. Likewise, it is conceivable that in other embodiments, it is possible to do without a handling plate as such, or a different connection element 30 on the adapter side can be provided.

Two wear plates 36 are disposed on the handling plate 32 as wear elements 34, on which plates the gripping head clamping elements 52 make contact when the adapter 20 is inserted into the gripping head 12 (see FIG. 5), and which plates can be rapidly unscrewed from the handling plate 32 and replaced in case of wear.

In this respect, the gripping head clamping elements 52 then serve as a connection element 50 on the stretcher-leveler side, wherein the connection element 30 on the adapter side and the connection element 50 on the gripping head side are accordingly part of a two-component connection system, with which the adapter 20 can be connected with the respective gripping head 12.

It is understood that in a modified embodiment, the handling plate 32 can be disposed on the adapter 20 in replaceable manner, for example, in order to serve as a closure element as such.

The adapter 20 has adapter clamping elements 40 that can be displaced in the direction 42 of the clamping force, wherein the direction 42 is oriented perpendicular to the stretching direction 16.

The adapter 20 has clamping hydraulics 44 to apply the clamping forces and to displace the adapter clamping elements 40.

Furthermore, a path measurement system 46 is provided, with which the displacement or the position of the adapter clamping elements 40 with reference to the adapter body 22 can be measured. Possible further measurement systems for measuring the clamping force or the clamping pressures are not shown.

Furthermore, a hydraulic quick coupling 48 and an electrical quick coupling 49 are provided on the adapter 20, which couplings can be connected, by way of a hydraulic line 18 and an electrical line 19, with a hydraulic quick coupling 58 and an electrical quick coupling 59, respectively, of the respective gripping head 12 (see FIG. 5), so that the adapter can be operated by way of the electrical supply as well as the hydraulic supply of the respective gripping head 12. A corresponding connection of the adapter 20 with the gripping head 12 can be made or eliminated by way of the quick couplings 48, 49, 58, 59, in rapid and operationally reliable manner.

As is directly evident, the adapter 20 is designed for smaller nominal plate widths, so that it is possible, using the stretcher-leveler 10, to particularly stretch plates having a thickness that lies below the nominal stretcher-leveler width of the actual stretcher-leveler 10 or its gripping heads 12.

Although only a few embodiments of the present invention have been shown and described, it is to be understood that many changes and modifications may be made thereunto without departing from the spirit and scope of the invention.

REFERENCE SYMBOL LIST

10 stretcher-leveler
12 gripping head
14 pressure element
16 stretching direction
18 hydraulic line
19 electrical line
20 adapter
22 adapter body
30 connection element on the adapter side
32 handling plate
33 handling plate side
34 wear element
36 wear plate
40 adapter clamping element
42 direction of the clamping force
44 clamping hydraulics for the adapter clamping element 40
46 path measurement system
48 hydraulic quick coupling
49 electrical quick coupling
50 connection element on the gripping head side
52 gripping head clamping element
54 clamping hydraulics for the gripping head 12
58 hydraulic quick coupling
59 electrical quick coupling

What is claimed is:

1. A method of operating a stretcher-leveler, the method comprising the steps of:

providing a stretcher-leveler having a plurality of gripping heads, the plurality of gripping heads comprising gripping head clamps for gripping a plate to be stretched, wherein the gripping head clamps are adjustable between a maximum gripping width and a minimum gripping width via clamping hydraulics for the gripping head;

connecting an adaptor to at least one gripping head of the plurality of gripping heads, the adaptor having adaptor clamps for clamping a plate to be stretched, the adaptor clamps being adjustable between a maximum adaptor clamping width and a minimum adaptor clamping width via clamping hydraulics for the adaptor;

clamping a plate between the adaptor clamps; and stretching the plate.

2. The operating method according to claim 1, wherein first, the respective gripping head of the stretcher-leveler is connected with the respective adapter, and subsequently the plate is clamped by way of the adapter clamps of the respective adapter and connected with the respective gripping head.

3. The operating method according to claim 1, wherein before the plate is connected with the respective gripping head by way of the adapter clamps, the respective adapter is hydraulically and/or electrically connected with the stretcher-leveler.

4. The operating method according to claim 3, wherein before the plate is connected with the respective gripping head by way of the adapter clamps, the respective adapter is hydraulically and/or electrically connected with the respective gripping head.

* * * * *